US005261780A

United States Patent [19]

Perry

[11] Patent Number: 5,261,780

[45] Date of Patent: Nov. 16, 1993

[54] OPTIONAL LOADER BUCKET LINKAGE ASSEMBLY

[75] Inventor: Robert N. Perry, Welland, Canada

[73] Assignee: Deere & Company, Moline, Ill.

[21] Appl. No.: 893,857

[22] Filed: Jun. 5, 1992

[51] Int. Cl.[5] ..... E02F 3/28

[52] U.S. Cl. ..... 414/723; 414/697

[58] Field of Search ..... 414/697, 686, 723

[56] References Cited

U.S. PATENT DOCUMENTS

| | | | |
|---|---|---|---|
| 4,643,631 | 2/1987 | Maurer et al. | 414/723 |
| 4,793,764 | 12/1988 | Hamm | 414/686 |
| 4,871,292 | 10/1989 | Milanowski | 414/723 |
| 4,986,722 | 1/1991 | Kaczmarczyk et al. | 414/723 |
| 5,078,569 | 1/1992 | Cook | 414/723 |

*Primary Examiner*—Michael S. Huppert

*Assistant Examiner*—Donale W. Underwood

[57] ABSTRACT

A loader has arms which are each provided with a linkage connection bushing located rearwardly of a connection bushing used for attaching the arms to a lower location of a bucket attaching bracket about which the bucket is pivotable by bucket cylinders respectively coupled between the bucket arms and upper locations of the bucket attaching brackets. An optional linkage is provided for coupling each bucket cylinder to the upper location of an adjacent bucket mounting bracket and includes a first link adapted for having one end coupled to the linkage connection bushing and a second link having one end adapted for connection to the upper location of the bucket attaching bracket and a second end adapted for connection to a second end of the first link and to the bucket cylinder.

1 Claim, 2 Drawing Sheets

OPTIONAL LOADER BUCKET LINKAGE ASSEMBLY

BACKGROUND OF THE INVENTION

The present invention relates to a tractor-mounted loader and more particularly relates to a bucket linkage for such loader.

Many types of structures are available to connect a bucket to the forward end of loader arms. Typically, a standard mounting arrangement is provided wherein pins or other fasteners are manually inserted to effect a direct connection between the arms and brackets of the bucket, or a somewhat enhanced mounting arrangement is provided wherein an upright holder or carrier is mounted to each of the arms with quick-coupling structure being used for automatically coupling the carrier to the bucket brackets. In these mounting assemblies, the cylinder is either connected between each arm and bucket bracket or between each arm and holder. U.S. Pat. No. 4,986,722 issued 22 Jan. 1991 discloses both of these types of mounting arrangements.

To increase bucket rollback angle and breakout power, a linkage assembly either including only a pair of links or including the pair of links together with an attachment carrier is connected between the cylinders and the loader bucket brackets. Loaders with and without linkage assemblies have heretofore only been available as unique and individual loader models, i.e., it has not been possible to field-convert a loader without a linkage assembly to one including such an assembly to improve performance.

SUMMARY OF THE INVENTION

According to the present invention there is provided an improved loader design which permits the loader to be field-converted for use either with or without a linkage assembly interposed between the bucket cylinders and the bucket.

An object of the invention is to provide a tractor-mounted loader having components for permitting a standard version of the loader to have linkage added thereto for enhancing rollback and breakout force without otherwise modifying the loader.

A more specific object of the invention is to provide a tractor-mounted loader including bucket cylinders having the correct open length for use without a linkage assembly and the correct closed length for use with a linkage assembly and to provide the loader arms with attaching points for links of the linkage assembly.

These and other objects of the invention will become apparent from a reading of the ensuing description together with the appended drawings.

DESCRIPTION OF THE PREFERRED EMBODIMENT

Various components may be described herein as occurring in pairs when only one of the pair is shown. It is to be understood that the component not shown is similar to or the mirror image of the illustrated component.

Figure 1:
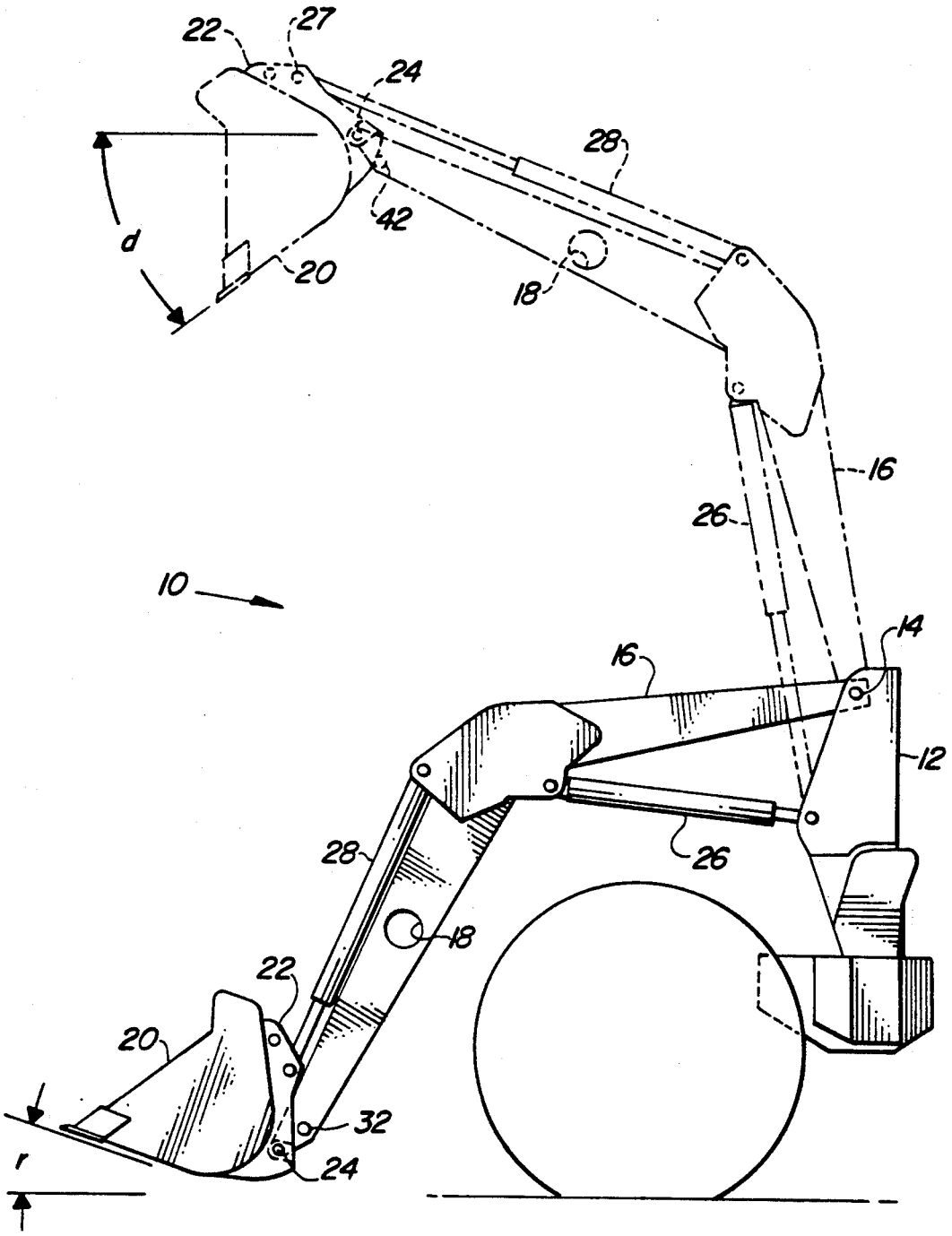
FIG. 1 is a somewhat schematic left side elevational view of a tractor-mounted loader without a linkage assembly and showing the bucket in solid lines in a lowered, maximum rollback position and showing the bucket in dashed lines in raised, maximum dump position.

Referring now to FIG. 1, therein is shown a loader 10 disposed as if it were supported on the main frame of a tractor (not shown). The loader 10 includes a pair of upright support posts or masts 12. Pivotally attached to upper ends of each of the masts, as by a pin 14, is the rear end of a loader arm 16. Each loader arm 16 extends forwardly and then downwardly from the associated mast 12 and joining the downwardly extending portions of each of the arms is a torque tube 18. A bucket 20 has a pair of mounting brackets 22 located on its backside with each bracket including a pair of spaced apart plates having the forward end of one of the loader arms 16 located therebetween and pivotally coupled to a lower part thereof by a coupling pin 24 which extends through aligned attaching bushings in each bracket and arm. It is here noted that the inside plate of each of the bucket brackets is provided with a rearwardly opening, square-shaped notch and that the bushing associated with each inside plate is carried by an insert plate that is releasably secured in blocking relationship to the notch (see the aforementioned U.S. Pat. No. 4,986,722 for a more detailed disclosure of the insert plate). Coupled between each mast 12 and arm 16 is a boom cylinder 26 which is operable for elevating the arms 16 between their lowered position, shown in solid lines, and their raised position shown in dashed lines. Coupled between each arm 16 and an upper location of each bucket bracket 22, as by a pin 27, is the rod end of a bucket cylinder 28 which is operable for pivoting the bucket 20 about the coupling pins 24. The bucket 20 is shown in solid lines in a lowered, maximum rollback position, wherein the bucket cylinder 28 is somewhat less than fully closed or retracted, and in dashed lines in a raised, maximum dump position wherein the cylinder is fully opened or extended. The bucket of the loader embodiment disclosed has a maximum rollback angle r of approximately 17° and a maximum dump angle d of approximately 36°, both angles being measured from the horizontal with the dump angle being given in absolute terms.

Figure 2:
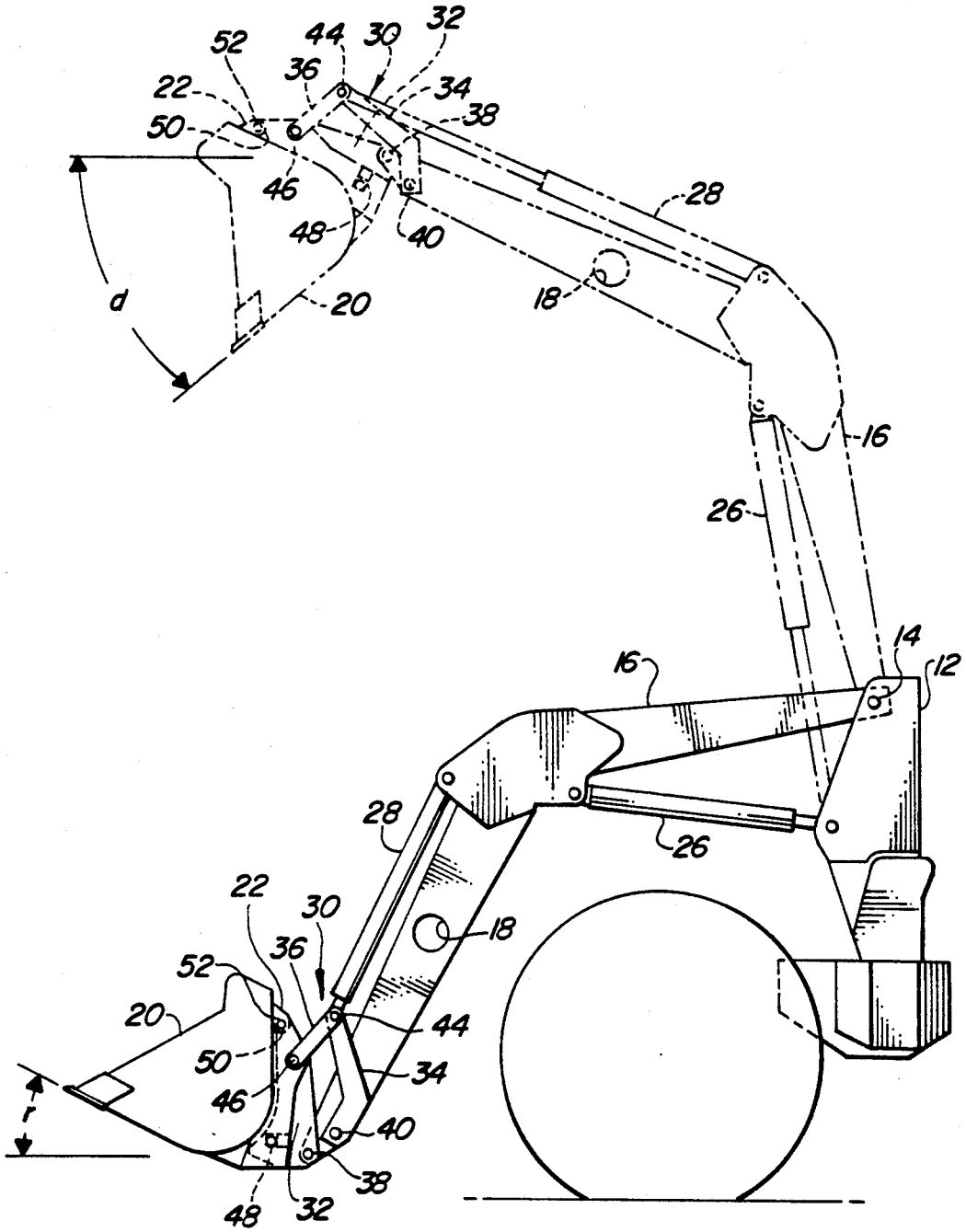
FIG. 2 is a view like FIG. 1 but showing the loader equipped with an optional linkage assembly located between the bucket and bucket cylinder.

Referring now to FIG. 2, the loader 10 is shown equipped with an optional linkage assembly 30 located between each of the bucket cylinders 28 and its associated bucket mounting bracket 22 so as to permit the bucket 20 to be moved through increased or enhanced rollback and dump angles. Specifically, each linkage assembly 30 includes an upright attachment holder 32, defining one of opposite ends of an attachment carrier, and first or boom and second or carrier links 34 and 36, respectively, which are each comprised of a pair of spaced, parallel link components. Each holder 32 includes spaced parallel plates disposed on opposite sides of and having a lower rear corner thereof pinned, as at 38, to the forward end of a respective one of the loader arms 16. The pair of link components of the first link 34 are generally L-shaped and have first ends disposed on opposite sides of the adjacent arm 16 and coupled thereto by a pin 40 received in a bushing 42 (FIG. 1) located in rearward spaced relationship to the pin 38. First ends of the link components of the second link 36 are located between second ends of the link components of the first link 34 and are coupled thereto and to the rod end of the cylinder 28 by a pin 44 while second ends of the link components of the second link 36 are located between and coupled to the spaced plates of the holder 32 by a pin 46, that is visible through the bushings that receive the pin 27 (FIG. 1). The holders 32 are joined together by a cross member 48 of square cross section located in a lower forward portion of the attachment carrier and this cross member is received in the notch provided in each of the inner plates of the bucket brackets 22, the insert plates used to block the notches, in the absence of the linkage assembly 30 like in FIG. 1, now being removed. The upper end of each holder 32 defines a saddle 50 that engages a pin 52 located in an upper end portion of the plates of a respective one of the holders 32. Any known quick-attach assembly (not shown) may be used for releasably securing the attachment carrier in place with the cross member 48 located in the bracket recesses and the holder saddles 50 receiving the pins 52.

The bucket 20 is shown in solid lines in a lowered, maximum rollback position, wherein the bucket cylinder 28 is fully closed or retracted, and in dashed lines in a raised, maximum dump position wherein the cylinder is somewhat less than fully opened or extended. The bucket 20 of the loader embodiment disclosed has a maximum rollback angle r, of approximately 27° and a maximum dump angle d of approximately 40°.

Thus, it will be appreciated that the addition of the linkage 30 in the loader embodiment disclosed results in the rollback angle being increased by approximately 10° and in the dump angle being increased by approximately 3.5°.

I claim:

1. In a combination of a loader having a pair of loader arms mounted for being moved between fully lowered and raised positions by a pair of arm cylinders and a bucket coupled to forward ends of the pair of arms for movement, by a pair of bucket cylinders, to a full roll back position when the bucket is resting on the ground with the arms in said fully lowered position and to a full dump position when the arms are in their fully raised position, an improved structure for permitting the loader to be configured either as a standard loader having the bucket arms and bucket cylinders connected directly to bucket brackets or as an enhanced loader having the bucket arms and bucket cylinders coupled to said bucket brackets by means of an optional linkage assembly, comprising: said bucket brackets each including a pair of spaced plates provided with upper and lower bracket bushings for being coupled to one of the cylinders and one of the arms, respectively, when the loader is configured as a standard loader; said linkage assembly for configuring said enhanced loader including a carrier having opposite ends defined by a pair of upright holders, a carrier link having a forward end coupled to an upper location of each holder and a boom link having an upper end pivotally coupled to and forming an articulated joint with a rearward end of said carrier link; a pair of coupling means releasably securing each holder to one of the bucket brackets; the coupling of said carrier link with said holder being in axial alignment with said upper bracket bushing of the associated bracket when said holder is secured thereto; the lower end of each boom link being pivotally coupled to one of the arms at an arm bushing located in the arm rearwardly of its forward end; each articulated joint of the carrier and boom links being connected to one of the bucket cylinders; and said bucket cylinders, carrier and boom links being so located and dimensioned that when the loader is configured as a standard loader the bucket will be fully rolled back with less than full retraction of the bucket cylinders and will be moved to a full dump position with full extension of the cylinders and that when the loader is configured as an enhanced loader the bucket will be fully rolled back, through an angle greater than that through which the bucket is moved when the loader is configured as a standard loader, with substantially full retraction of the cylinders and will be moved to a full dump position, through an angle greater than that through which the bucket is moved when the loader is configured as a standard loader, with slightly less than full extension of the cylinders, whereby said loader may be optionally configured as a standard or enhanced loader without changing the cylinders or the location of the points of attachment of the bucket brackets.

* * * * *